US011154997B2

(12) United States Patent
De Vries et al.

(10) Patent No.: US 11,154,997 B2
(45) Date of Patent: Oct. 26, 2021

(54) METHOD AND APPARATUS FOR PROVIDING FEEDBACK REGARDING MOTION OF A ROTARY SHAVER PERFORMED BY A USER

(71) Applicant: KONINKLIJKE PHILIPS N.V., Eindhoven (NL)

(72) Inventors: Siebrand Leen De Vries, Drachten (NL); Yue Wu, Amsterdam (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 66 days.

(21) Appl. No.: 16/611,258

(22) PCT Filed: May 11, 2018

(86) PCT No.: PCT/EP2018/062274
§ 371 (c)(1),
(2) Date: Nov. 6, 2019

(87) PCT Pub. No.: WO2018/206805
PCT Pub. Date: Nov. 15, 2018

(65) Prior Publication Data

US 2020/0156272 A1 May 21, 2020

(30) Foreign Application Priority Data

May 11, 2017 (EP) ..... 17170662

(51) Int. Cl.
*B26B 19/14* (2006.01)
*B26B 19/38* (2006.01)

(52) U.S. Cl.
CPC ..... *B26B 19/388* (2013.01); *B26B 19/145* (2013.01); *B26B 19/3826* (2013.01)

(58) Field of Classification Search
CPC . B26B 19/388; B26B 19/145; B26B 19/3826; B26B 19/3873
See application file for complete search history.

(56) References Cited

U.S. PATENT DOCUMENTS 8,397,388 B1 * 3/2013 Steinberg ..... B26B 19/28 30/43.5
8,744,192 B2 * 6/2014 Ortins ..... A46B 15/0008 382/195

(Continued)

FOREIGN PATENT DOCUMENTS

WO 2014/036423 3/2014
WO 2015/067489 5/2015

(Continued)

OTHER PUBLICATIONS

International Search Report and Written Opinion dated Aug. 13, 2018 for International Application No. PCT/EP2018/062274 Filed May 11, 2018.

*Primary Examiner* — Kenneth E Peterson
*Assistant Examiner* — Liang Dong

(57) ABSTRACT

There is provided a method of providing feedback regarding motion of a rotary shaver performed by a user, the method comprising the steps of receiving, during at least one time interval, at least one motion type determined for the motion of the rotary shaver performed by the user, wherein the motion type is selected from a set of predefined motion types that comprises small rotational motion and one or more other predefined motion types; determining a degree of occurrence in the time interval of each of the motion types in the set of time interval; determining from the determined degree of occurrence of each of the motion types in the set of predefined motion types which motion type has a highest degree of occurrence in the time interval; and providing feedback to the user to increase a degree of occurrence of (Continued)

small rotational motion of the rotary shaver if the determined motion type having the highest degree of occurrence is one of the other predefined motion types.

15 Claims, 8 Drawing Sheets

(56) References Cited

U.S. PATENT DOCUMENTS

| | | | | |
|---|---|---|---|---|
| 2016/0262521 | A1* | 9/2016 | Kustra | A45D 27/00 |
| 2018/0236675 | A1* | 8/2018 | Westerhof | G06F 16/9038 |

FOREIGN PATENT DOCUMENTS

| | | |
|---|---|---|
| WO | 2017/002004 | 1/2017 |
| WO | 2017/005868 | 1/2017 |

* cited by examiner

METHOD AND APPARATUS FOR PROVIDING FEEDBACK REGARDING MOTION OF A ROTARY SHAVER PERFORMED BY A USER

CROSS REFERENCE TO RELATED APPLICATIONS

This application is the U.S. National Phase application under 35 U.S.C. § 371 of International Application No. PCT/EP2018/062274 filed May 11, 2018, published as WO 2018/206805 on Nov. 15, 2018, which claims the benefit of European Patent Application Number 17170662.5 filed May 11, 2017. These applications are hereby incorporated by reference herein.

TECHNICAL FIELD OF THE INVENTION

The invention relates to a method and apparatus for providing feedback regarding motion of a rotary shaver performed by a user of the rotary shaver.

BACKGROUND OF THE INVENTION

Shaving performance, for example in terms of the closeness of the shave and irritation caused to the skin, is largely influenced by the handling of a shaver by the user. It is known that people with a high degree of skin irritation after shaving could benefit from receiving advice or guidance about how to improve shaving motion and the pressure with which the shaver is applied to the user's skin. This is particularly the case for rotary shavers in which hairs are cut using cutting elements that comprise one or more circular blades that rotate rapidly.

WO 2015/067489 describes a system and a method for guiding a user during a shaving procedure in which an image sensor registers an image of a part of the body of the user, an image analyzer determines a local hair-growth direction based on data in the image, a controller generates instructions about a direction in which a hair cutting device is to be moved in dependence on the determined local hair-growth direction, and a feedback system that provides the instructions to the user. It is also described that the movement of the device can be reconstructed with an accelerometer and may indicate that the user should change the manipulation of the hair cutting device.

However, improvements in the feedback provided regarding the motion of a rotary shaver performed by a user are desired to further improve the shaving performance.

SUMMARY OF THE INVENTION

It has been found that moving a rotary shaver with small rotational motions provides an improved shaving performance, particularly in terms of reducing skin irritation. Therefore, the invention provides that the motion of a rotary shaver is assessed and feedback is provided to the user to increase the degree of occurrence of small rotational motion performed by the user.

According to a first aspect of the invention, there is provided a method of providing feedback regarding motion of a rotary shaver performed by a user, the method comprising the steps of receiving, during at least one time interval, at least one motion type determined for the motion of the rotary shaver performed by the user, wherein the motion type is selected from a set of predefined motion types that comprises small rotational motion and one or more other predefined motion types; determining a degree of occurrence in the time interval of each of the motion types in the set of predefined motion types based on the at least one motion type received during the time interval; determining from the determined degree of occurrence of each of the motion types in the set of predefined motion types which motion type has a highest degree of occurrence in the time interval; and providing feedback to the user to increase a degree of occurrence of small rotational motion of the rotary shaver if the determined motion type having the highest degree of occurrence is one of the other predefined motion types and is not a no motion motion type. The method according to the first aspect of the invention provides the advantage that feedback can be provided quickly and reliably, enabling the user to optimise the motion of the rotary shaver to minimise skin irritation.

In an embodiment of the method according to the invention, the method further comprises the step of providing feedback to the user indicating that the degree of occurrence of small rotational motion of the rotary shaver is acceptable if the determined motion type having the highest degree of occurrence is small rotational motion.

In some embodiments of the method according to the invention, the one or more other predefined motion types comprises one motion type that is any motion that is not small rotational motion.

In a preferred embodiment of the method according to the invention, the one or more other predefined motion types comprises one or more of large rotational motion, stroke, large stroke and small stroke.

In a further embodiment of the method according to the invention, the set of predefined motion types comprises a no motion type, and the method further comprises the step of providing feedback to the user to start moving the rotary shaver if the determined motion type having the highest degree of occurrence is no motion.

In an embodiment of the method according to the invention, the step of receiving at least one motion type comprises receiving a respective motion type at each of a plurality of points of time in the time interval. In this embodiment, the degree of occurrence in the time interval of a particular motion type in the set of predefined motion types may be a number of points of time of said plurality of points of time at which said particular motion type is received. In this embodiment, the step of determining which motion type has the highest degree of occurrence in the time interval may comprise counting, for each motion type, the number of points of time of said plurality of points of time in the time interval at which the respective motion type is received, and determining which motion type has the highest counted number of points of time in the time interval.

In a further embodiment of the method according to the invention, the degree of occurrence in the time interval of a particular motion type in the set of predefined motion types is a frequency with which said particular motion type occurs within the time interval. In this embodiment, the step of determining which motion type has the highest degree of occurrence in the time interval may comprise determining which motion type has the highest frequency in the time interval.

In a yet further embodiment of the method according to the invention, the degree of occurrence in the time interval of a particular motion type in the set of predefined motion types is a duration of said particular motion type within the time interval. In this embodiment, the step of determining which motion type has the highest degree of occurrence in the time interval comprises determining which motion type has the longest duration in the time interval.

In a preferred embodiment of the method according to the invention, the step of receiving at least one motion type comprises receiving from the rotary shaver the at least one motion type determined for the motion of the rotary shaver performed by the user.

In a further preferred embodiment of the method according to the invention, small rotational motion corresponds to a rotational motion about a central region such that each point on skin of the user in said central region is in contact with the rotary shaver for at least part of the rotational motion. In this embodiment, small rotational motion includes a rotational motion along a circular path wherein a diameter of the circular path is such that a point on skin of the user at a centre point of the circular path is in contact with the rotary shaver for at least part of the rotational motion.

According to a second aspect of the invention, there is provided a computer program product comprising a computer readable medium having computer readable code embodied therein, the computer readable code being configured such that, on execution by a suitable computer or processor, the computer or processor is caused to perform any of the methods described above.

According to a third aspect of the invention, there is provided an apparatus for providing feedback regarding motion of a rotary shaver performed by a user, the apparatus comprising a feedback unit for providing feedback to the user; and a processing unit configured to receive, during at least one time interval, at least one motion type determined for the motion of the rotary shaver performed by the user, wherein the motion type is selected from a set of predefined motion types that comprises small rotational motion and one or more other predefined motion types; determine a degree of occurrence in the time interval of each of the motion types in the set of predefined motion types based on the at least one motion type received during the time interval; determine from the determined degree of occurrence of each of the motion types in the set of predefined motion types which motion type has a highest degree of occurrence in the time interval; and cause the feedback unit to provide feedback to the user to increase a degree of occurrence of small rotational motion of the rotary shaver if the determined motion type having the highest degree of occurrence is one of the other predefined motion types and is not a no motion motion type. The apparatus according to the third aspect of the invention provides the advantage that feedback can be provided quickly and reliably, enabling the user to optimise the motion of the rotary shaver to minimise skin irritation.

In some embodiments of the apparatus according to the invention, the processing unit is further configured to provide feedback to the user indicating that the degree of occurrence of small rotational motion of the rotary shaver is acceptable if the determined motion type having the highest degree of occurrence is small rotational motion.

In a preferred embodiment of the apparatus according to the invention, the one or more other predefined motion types comprises one motion type that is any motion that is not small rotational motion.

In a further preferred embodiment of the apparatus according to the invention, the one or more other predefined motion types comprises one or more of large rotational motion, stroke, large stroke and small stroke.

In a further embodiment of the apparatus according to the invention, the set of predefined motion types comprises a no motion type, and the processing unit is further configured to provide feedback to the user to start moving the rotary shaver if the determined motion type having the highest degree of occurrence is no motion.

In a preferred embodiment of the apparatus according to the invention, the processing unit is configured to receive a respective motion type at each of a plurality of points of time in the time interval. In this embodiment, the degree of occurrence in the time interval of a particular motion type in the set of predefined motion types may be a number of points of time of said plurality of points of time at which the processing unit receives said particular motion type. In this embodiment, the processing unit may be configured to determine which motion type has the highest degree of occurrence in the time interval by counting, for each motion type, the number of points of time of said plurality of points of time in the time interval at which the processing unit receives the respective motion type, and by determining which motion type has the highest counted number of points of time in the time interval.

In a further embodiment of the apparatus according to the invention, the degree of occurrence in the time interval of a particular motion type in the set of predefined motion types is a frequency with which said particular motion type occurs within the time interval. In this embodiment, the processing unit may be configured to determine which motion type has the highest degree of occurrence in the time interval by determining which motion type has the highest frequency in the time interval.

In a yet further embodiment of the apparatus according to the invention, the degree of occurrence in the time interval of a particular motion type in the set of predefined motion types is a duration of said particular motion type within the time interval. In this embodiment, the processing unit may be configured to determine which motion type has the highest degree of occurrence in the time interval by determining which motion type has the highest duration in the time interval.

In a further embodiment of the apparatus according to the invention, the processing unit is configured to receive from the rotary shaver the at least one motion type determined for the motion of the rotary shaver performed by the user.

In a preferred embodiment of the apparatus according to the invention, small rotational motion corresponds to a rotational motion about a central region such that each point on skin of the user in said central region is in contact with the rotary shaver for at least part of the rotational motion. In this embodiment, small rotational motion includes a rotational motion along a circular path wherein a diameter of the circular path is such that a point on skin of the user at a centre point of the circular path is in contact with the rotary shaver for at least part of the rotational motion.

According to a fourth aspect of the invention, there is provided a system for providing feedback regarding motion of a rotary shaver performed by a user, the system comprising any of the apparatus as described above, a rotary shaver, and a movement sensor for measuring movement of the rotary shaver over time.

In a preferred embodiment of the system according to the invention, the rotary shaver further comprises a shaver processing unit that is configured to receive measurements of the movement of the rotary shaver over time from the movement sensor, process the received measurements to determine, during the at least one time interval, the at least one motion type for the motion of the rotary shaver performed by the user, and provide the determined at least one motion type to the processing unit of the apparatus.

In an alternative embodiment of the system according to the invention, the processing unit of the apparatus is further configured to receive measurements of the movement of the rotary shaver over time from the movement sensor, and process the received measurements to determine, during the at least one time interval, the at least one motion type for the motion of the rotary shaver performed by the user.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE PREFERRED EMBODIMENTS

As noted above, the invention is for providing feedback on the motion of a rotary shaver performed by a user. A rotary shaver is a type of shaver that cuts hairs using cutting elements that comprise one or more circular blades that rotate rapidly. Preferably, as found by the inventors, the rotary shaver is to be moved over the skin using a rotational motion, so that the shaver for example follows an approximately circular path on the skin of the user. A rotary shaver typically comprises at least two cutting elements, and preferably three cutting elements arranged in a triangle, although rotary shavers having different numbers of cutting elements and/or arrangements are available. It has been found that moving a rotary shaver with small rotational motions provides an improved shaving performance, particularly in terms of reducing skin irritation. Small rotational motions can be, for example, circular motions along a circular path wherein the diameter of the circular path is such that the point on the user's skin corresponding to the centre point of the circular path of the rotational motion is in contact with the rotary shaver, i.e. is covered by the rotary shaver, for at least part of the rotational motion. Following this exemplary definition, large rotational motion is a circular motion along a circular path wherein the diameter of the circular path is such that there is at least one point of skin, in a central region enclosed by the circular path, that is not in contact with the rotary shaver at all during a full rotation of the rotary shaver over the skin along the circular path.

Generally, however, the term "small rotational motion" is to be understood as a rotational motion of the rotary shaver over the user's skin, wherein the rotary shaver generally follows a curved closed path about a central region which is enclosed by the curved closed path, and wherein each point on the user's skin in said central region is in contact with the rotary shaver for at least part of a full rotational motion of the rotary shaver along the curved closed path. In embodiments wherein the path is circular or elliptical, said central region comprises the centre point of the circular or elliptical path. However, said path may also be non-circular and non-elliptical, in which case said central region is generally to be understood as comprising a geometrical centre point of the curved closed path.

Figure 1A:
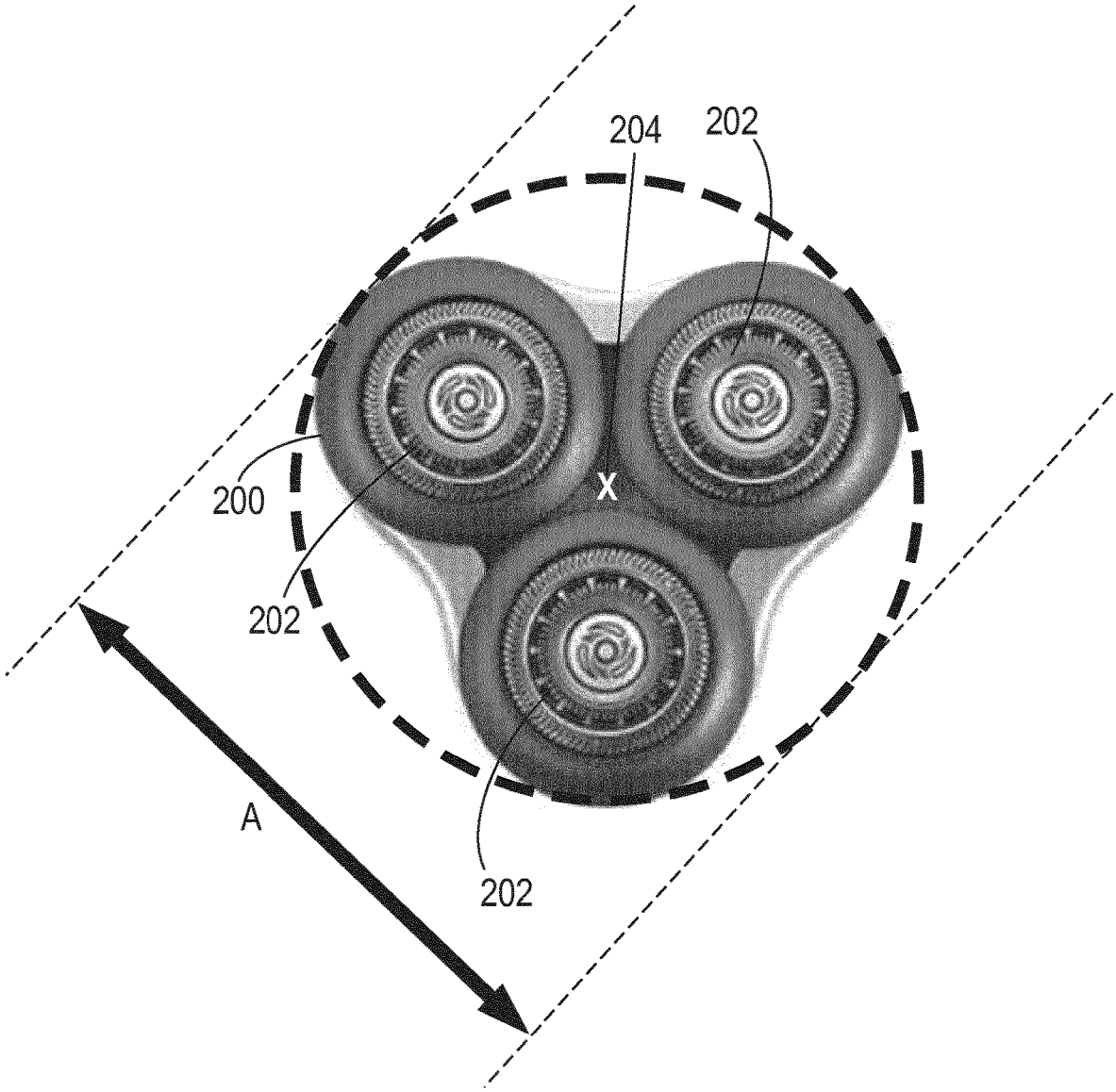
FIGS. 1(*a*) and 1(*b*) illustrate an exemplary definition of small rotational motion in an embodiment of a method according to the invention.
Figure 1B:
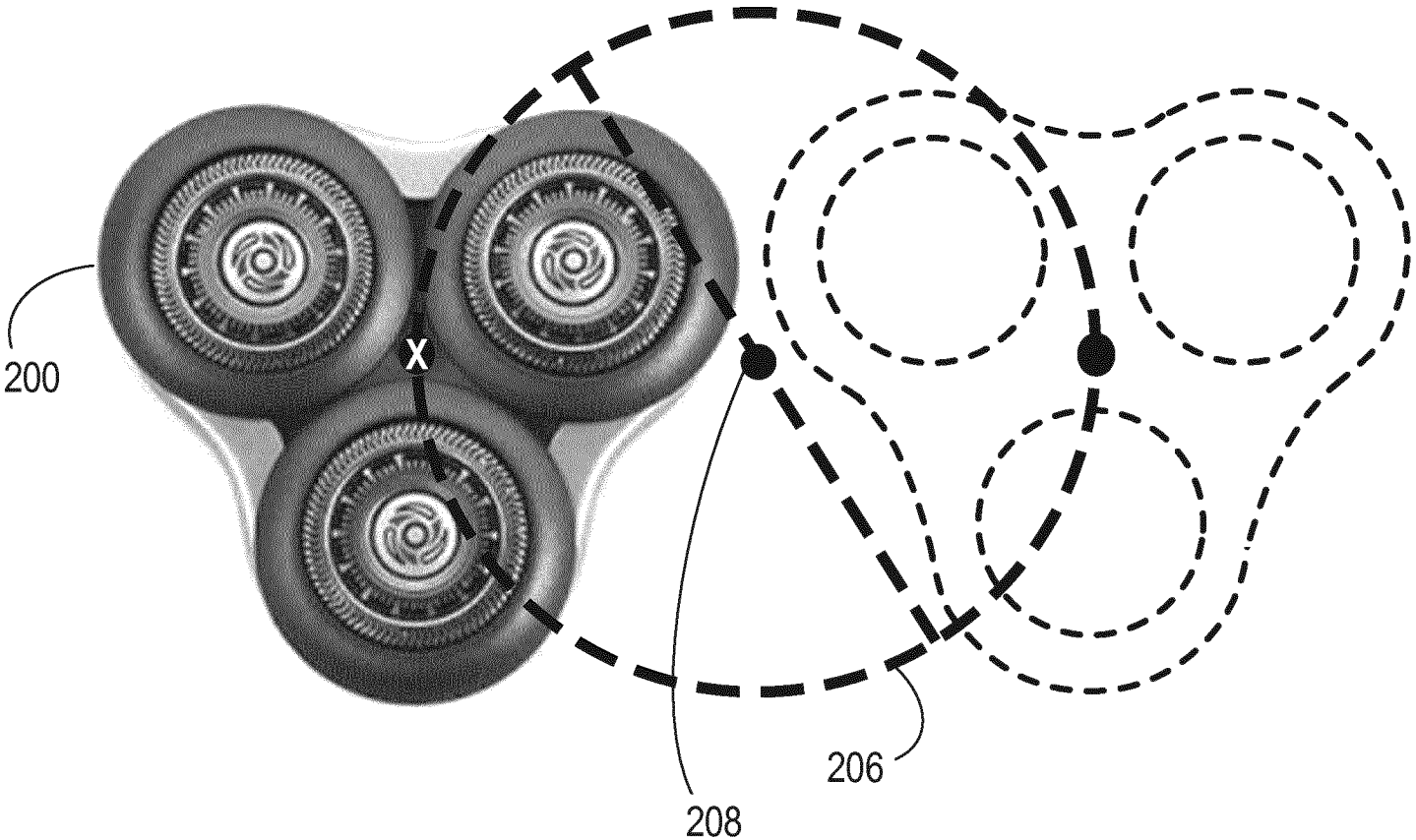

This is illustrated in FIG. 1. FIG. 1(*a*) shows a shaving unit 200, having three cutting elements 202 arranged in a triangular configuration. The geometrical centre or midpoint of the shaving unit 200 is marked as 204. Distance A is shown that is the diameter of the shaving unit 200 and in particular is the diameter of a circle that circumscribes the shaving unit 200. In a typical shaving unit 200, the distance A is approximately 5 cm-6 cm, although other sizes can be used, and for reference the typical diameter of a cutting element 202 is approximately 2 cm-2.5 cm, although again other sizes can be used.

As set out above, small rotational motion generally is the rotational motion about a central region such that each point on the user's skin located in said central region is covered (i.e. in contact with the shaving unit 200) for at least part of the rotational motion. In the example of a circular motion, this means that the diameter of the circular path followed by the rotational motion should be equal to or less than the distance A for the rotational motion to be small rotational motion. FIG. 1(*b*) shows the example of a rotational circular motion of the shaving unit 200. In particular, dashed circle 206 shows the circular path taken by the centre 204 of the shaving unit 200 when the diameter of the circular path of the rotational motion is equal to A. The centre of the rotational motion is shown as point 208 and, when the rotational motion has a diameter A, the centre point 208 of the rotational motion is covered by the shaving unit 200 for at least part of the full rotation (i.e. it is covered at least once during one full rotation of the shaving unit 200 along the path 206). Any rotational motion having a diameter less than A will result in a central region centred on point 208 being covered for at least part of the full rotation. However, if the rotational motion path has a diameter greater than A, then at least the skin at the centre point 208 will not be covered at all during a full rotation of the shaving unit 200 along the path 206. Therefore, the invention provides that the motion of a rotary shaver is assessed and feedback is provided to the user to increase the degree of occurrence of small rotational motion performed by the user.

Figure 2:
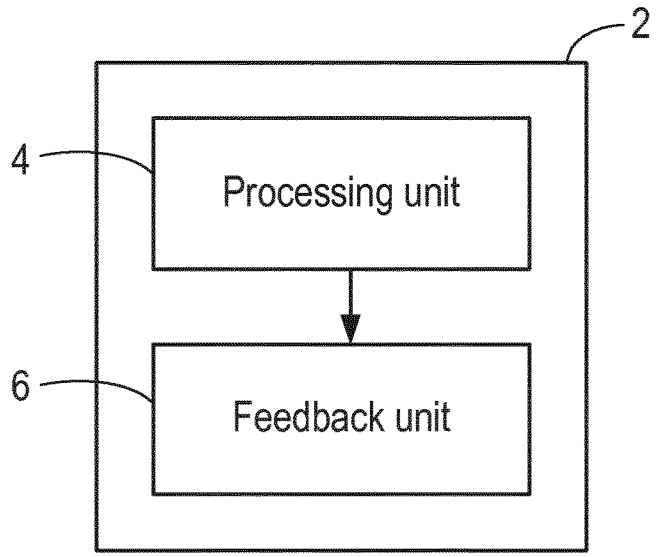
FIG. 2 is a block diagram of an apparatus for providing feedback regarding motion of a rotary shaver performed by a user according to the invention.

FIG. 2 shows a block diagram of an apparatus 2 for providing feedback regarding motion of a rotary shaver performed by a user according to an aspect of the invention. The apparatus 2 comprises a processing unit 4 and a feedback unit 6. In some embodiments, the apparatus 2 is in the form of an electronic device, such as a smart phone, tablet, personal digital assistant (PDA), laptop, desktop computer, smart mirror, etc. In other embodiments, the apparatus 2, and particularly the functionality according to the invention provided by the apparatus 2, is part of the rotary shaver.

The processing unit 4 generally controls the operation of the apparatus 2. Briefly, the processing unit 4 is to receive information indicating one or more motion types that is being performed by a user during a time interval, and to determine feedback to be provided to the user based on the received motion types. In some embodiments, the processing unit 4 can be configured to receive the information on the motion types from another component of the apparatus 2 and therefore the processing unit 4 can include or comprise one or more input ports or other components for receiving the information indicating the motion types from the other component. In other embodiments, the processing unit 4 can determine the information on the motion types from other information received by the processing unit 4, such as measurements of the movements or motion of the rotary shaver, and therefore the processing unit 4 can include or comprise one or more input ports or other components for receiving the measurements of the motion of the rotary shaver.

The processing unit 4 can signal the feedback or type of feedback to be provided to the user to the feedback unit 6, and therefore the processing unit 4 can comprise one or more output ports or other components for signalling the feedback or type of feedback to be provided to the feedback unit 6.

The processing unit 4 can be implemented in numerous ways, with software and/or hardware, to perform the various functions described below. The processing unit 4 may comprise one or more microprocessors or digital signal processors (DSPs) that may be programmed, using software or computer program code, to perform the required functions and/or to control components of the processing unit 4 to effect the required functions. The processing unit 4 may be implemented as a combination of dedicated hardware to perform some functions (e.g. amplifiers, pre-amplifiers, analog-to-digital convertors (ADCs) and/or digital-to-analog convertors (DACs)) and a processor (e.g., one or more programmed microprocessors, controllers, DSPs and associated circuitry) to perform other functions. Examples of components that may be employed in various embodiments of the present disclosure include, but are not limited to, conventional microprocessors, DSPs, application specific integrated circuits (ASICs), and field-programmable gate arrays (FPGAs).

The processing unit 4 can comprise or be associated with a memory unit (not shown in FIG. 2), such as a volatile or non-volatile computer memory such as RAM, PROM, EPROM, and EEPROM. The memory unit can be used for storing program code that can be executed by a processor in the processing unit 4 to cause the apparatus 2 to perform the various functions and methods described herein. In particular embodiments, the program code can be in the form of a smart phone application or tablet application.

The feedback unit 6 is for providing the feedback to the user on the motion of the rotary shaver performed by the user. The feedback can be in any suitable or desired form, including one or more of a visual element, an audible element, a haptic (tactile) element, etc., and the feedback unit 6 can be in a form that is able to provide or output those elements. The visual element can comprise a message in the form of letters, numbers, symbols, pictures, a video message, etc. and therefore the feedback unit 6 can comprise or be a display screen, such as that used on a smart phone, tablet, smart mirror or other personal electronic device. Alternatively (or in addition), the visual element can be provided using one or more lights (e.g. one or more light emitting diodes (LEDs)) having one or more colours (e.g. red, orange, yellow, green, etc.). The audible element can comprise a tone or beep, a verbal message, etc., and therefore the feedback unit 6 can comprise a speaker for generating the required audio. The haptic element may comprise a vibration of a particular intensity and/or duration, and therefore the feedback unit 6 can comprise a component that can generate vibrations, for example a vibration motor. It will be appreciated that the feedback to be provided may comprise multiple types of feedback (e.g. visual and audible), and therefore feedback unit 6 can be configured or capable of providing feedback of the appropriate type(s). It will be appreciated that certain devices, for example a smart phone or tablet, typically comprises components capable of providing the different types of feedback set out above.

It will be appreciated that the apparatus 2 may comprise additional components to those shown in FIG. 2. For example the apparatus 2 may comprise a power source, such as a battery, or a power interface component, such as plug, for connecting to the apparatus 2 to a mains power supply. The apparatus 2 may also or alternatively comprise a user interface that can enable a user to interact with the apparatus 2, for example to activate or deactivate the apparatus 2, and/or to control one or more settings or operations of the apparatus 2. The user interface can comprise any one or more of a touch screen, button, switch, keypad, keyboard, mouse, stylus, etc.

Figure 3:
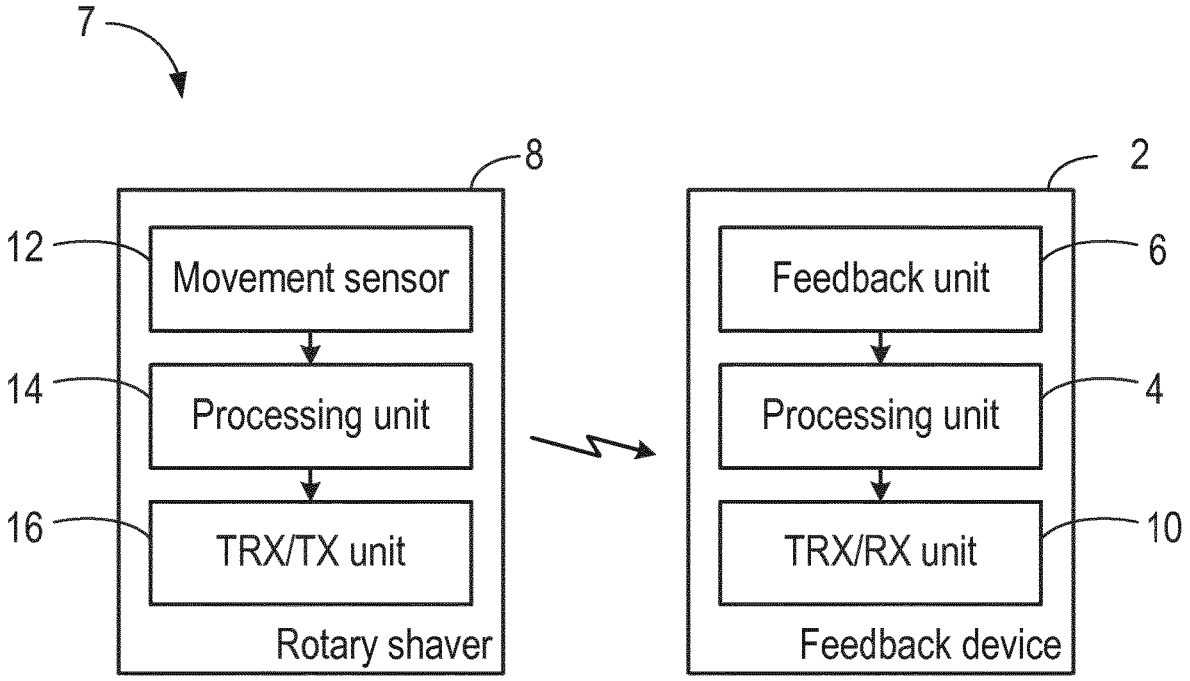
FIG. 3 is a block diagram of a system comprising an apparatus according to an embodiment of the invention and a rotary shaver.

A specific embodiment of an apparatus 2 as part of a system 7 is shown in FIG. 3. In this embodiment, the apparatus 2 is a separate device to the rotary shaver, and thus FIG. 3 shows the system 7 comprising an apparatus 2 and the rotary shaver 8. The apparatus 2, which is also referred to as a feedback device 2, comprises a processing unit 4 and feedback unit 6 as described above, and also comprises a transceiver or receiver unit 10 that is for receiving signals from the rotary shaver 8. The transceiver or receiver unit 10 can be configured to operate according to any desired wireless or wired communication standard, for example Ethernet, Bluetooth, Wi-Fi, ZigBee, NFC, or any $3^{rd}$, $4^{th}$ or $5^{th}$ generation cellular telecommunications standard.

The rotary shaver 8 is shown as comprising a movement sensor 12, a shaver processing unit 14 and a transceiver or transmitter unit 16. The transceiver or transmitter unit 16 is for transmitting signals from the rotary shaver 8 to the feedback unit/apparatus 2. The transceiver or transmitter unit 16 can be configured to operate according to any desired wireless or wired communication standard, for example Ethernet, Bluetooth, Wi-Fi, ZigBee, NFC, or any $3^{rd}$, $4^{th}$ or $5^{th}$ generation cellular telecommunications standard, as required in order to communicate with the transceiver or receiver unit 10 in the feedback device 2.

The movement sensor 12 is for measuring the movement or motion of the rotary shaver 8 during use of the shaver 8 by the user. The movement sensor 12 is preferably integral with or otherwise fixed to the shaver 8 so that the movement sensor 12 directly measures the motion of the rotary shaver 8. In some embodiments, the movement sensor 12 is an accelerometer, for example that measures acceleration along three orthogonal axes. Alternatively or in addition, the movement sensor 12 can comprise a gyroscope or a magnetometer. In alternative embodiments to that shown in FIG. 3, the movement of the rotary shaver 8 can be measured by a movement sensor in the form of a camera or other image capture device that is separate from the shaver 8 and that observes and records the motion of the shaver 8. The images can be analysed to extract the motion of the shaver 8 over time.

The shaver processing unit 14 generally controls the operation of the rotary shaver 8, for example activating and deactivating one or more cutting elements to effect a shaving or other hair cutting operation. The shaver processing unit 4 can be implemented in numerous ways, with software and/or hardware, similarly to the processing unit 4 in the feedback device 2.

The shaver processing unit 14 is connected to the movement sensor 12 and receives measurements of the motion of the rotary shaver 8 from the movement sensor 12, for example via an input port to the shaver processing unit 14. In some embodiments, the shaver processing unit 14 may output the measurements (e.g. raw acceleration data) of the motion to the transceiver or transmitter unit 16 for transmission to the feedback device 2 for subsequent processing. In alternative embodiments, the shaver processing unit 14 processes the measurements to identify or determine the motion type that the user is performing with the rotary shaver 8 at that time, and the shaver processing unit 14 outputs the identified motion type to the transceiver or transmitter unit 16 for transmission to the feedback device 2 for subsequent processing. In other alternative embodiments, the shaver processing unit 14 processes the measurements to identify or determine the motion type that the user is performing with the rotary shaver 8 at that time, processes the identified motion type(s) to determine the feedback that is to be provided to the user, and outputs a signal indicating the feedback to be provided to the transceiver or transmitter unit 16 for transmission to the feedback device 2 for presentation to the user. In a preferred implementation of FIG. 3, the apparatus 2 is a smart phone that is executing an application that provides the functionality according to the invention, and the shaver 8 and smart phone 2 communicate using Bluetooth.

According to embodiments of the invention, the feedback unit 6 is used to give feedback to the user on their shaving behaviour. While shaving using the rotary shaver 8 equipped with an accelerometer or other movement sensor 12, the motion of the shaver 8 is monitored and analysed. If the user moves the shaver 8 using small rotational motions, e.g. the shaver 8 follows a generally circular or elliptical path on the body of the user, the user can be notified via the feedback unit 6 that the motion is correct. However, if the user deviates from making small rotational motions with the shaver 8, the user can be notified via the feedback unit 8 that the motion should be changed to small rotational motion.

Figure 4:
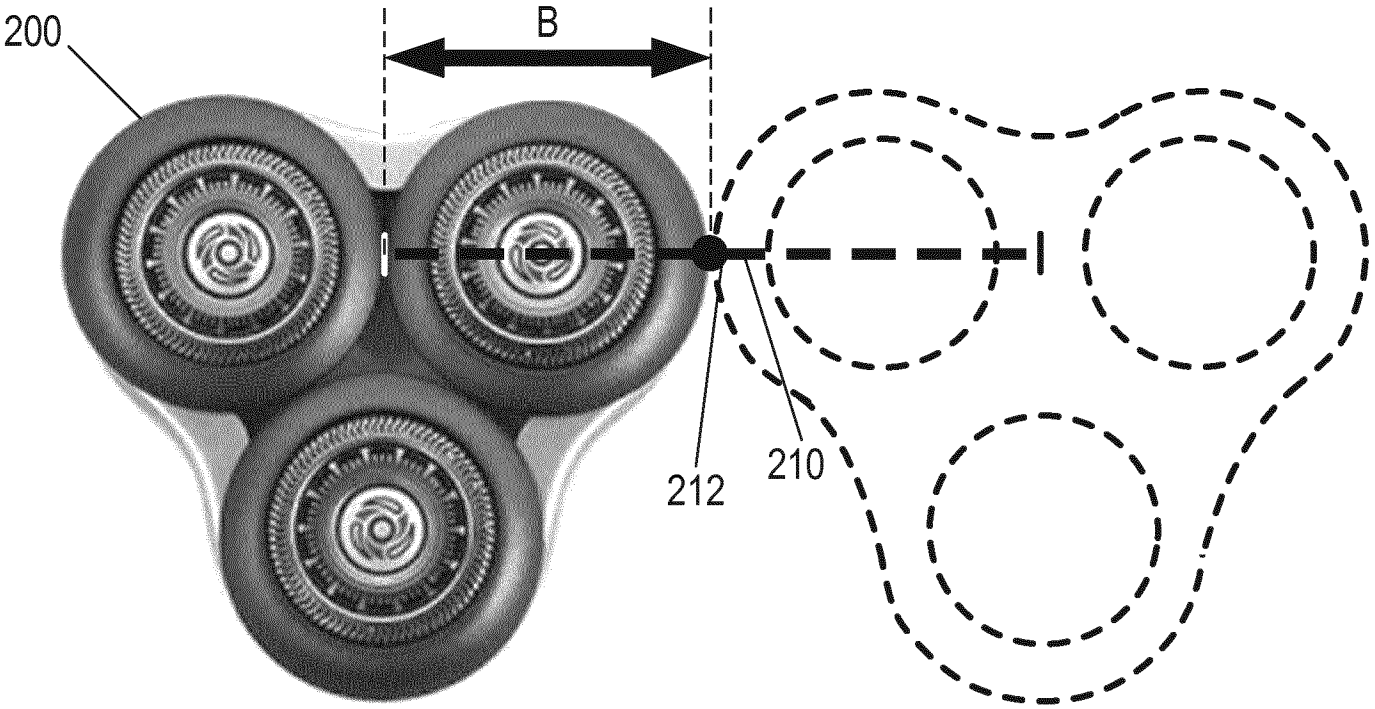
FIG. 4 illustrates an exemplary definition of small stroke in an embodiment of a method according to the invention.

The analysis of the motion of the shaver 8 can comprise determining a motion type of the shaver 8 for respective time periods or at respective points in time, combining the determined motion types for consecutive time periods or consecutive points in time in a time interval, and determining the feedback to be provided to the user based on the combination. The determined motion type is selected from a set of predefined motion types. The set of predefined motion types comprises small rotational motion and at least one other predefined motion type, such as large rotational motion, stroke (e.g. in which the shaver 8 follows a straight path), large stroke and small stroke (an example of which is illustrated in FIG. 4). In some embodiments, the at least one other predefined motion type simply comprises any non-small rotational motion (i.e. any motion that is not small rotational motion). The at least one other predefined motion type can also include "no motion", where the shaver 8 is not being moved by the user (or the speed or magnitude of movement is low, i.e. below a predefined threshold).

FIG. 4 illustrates an exemplary definition of small stroke in an embodiment of the invention. Small stroke can be, for example, a motion where the length of the stroke is such that there is at least one point on the user's skin that is always covered by the shaving unit, i.e. in contact with the shaving unit, during the stroke motion. Following this definition, large stroke is a motion wherein the length of the stroke is such that there is no point on the user's skin that is always covered by the shaving unit during the stroke motion. FIG. 4 shows the shaving unit 200 as shown in FIG. 1(*a*) with a stroke length at the boundary between small stroke and large stroke according to this definition. Distance B is defined that is the diameter of a cutting element 202. It will be appreciated from FIG. 1(*a*) that 2*B is slightly smaller than distance A in FIG. 1(*a*). In this definition, therefore, small stroke is a stroke along a straight path with a length that is equal to or less than the distance 2*B. Dashed line 210 shows the straight path taken by the shaving unit 200 when the length of the path is 2*B. Thus, it can be seen that there is a point 212 on the user's skin at the midpoint of the straight path 210 that will always be covered during the stroke motion if the stroke length is equal to or less than 2*B. Any stroke lengths greater than 2*B will imply that the midpoint of the path 210 on the user's skin will not always be covered by the shaving unit 200 during the stroke motion, and in this example stroke lengths greater than 2*B are considered to be large strokes. It will be appreciated that in alternative embodiments a different definition of large stroke and small stroke can be used, for example wherein large stroke is a stroke motion with a length greater than distance A in FIG. 1(*a*) and small stroke is a stroke motion with a length equal to or smaller than distance A.

The decision on the feedback to be provided to the user is made based on the degree of occurrence of each of the motion types in said time interval. For example, the degree of occurrence of a particular motion type in the time interval can be the frequency with which said particular motion type occurs within the time interval, and the motion type that has occurred most frequently can be used to determine the type of feedback to provide. This embodiment is most appropriate where each of the time periods is of the same length. In the event that the most frequent motion type is 'small rotational motion', the user can be provided with feedback indicating that he is performing the correct motion. In the event that the most frequent motion type is 'no motion', the user can be provided with feedback indicating that he should start shaving. In all other cases, the user can be provided with feedback indicating that he should move the shaver 8 with small rotational movements, or that he should otherwise increase the occurrence of small rotational movements.

If the time periods for which the motion types are provided do not have the same length (e.g. some time periods are shorter or longer than others), then the degree of occurrence can be the duration of each motion type in the time interval. The duration of a particular motion type in the time interval can be the sum of the durations of the time periods in which said particular motion type has occurred. In this case the motion type having the longest duration determines the feedback to be provided to the user.

Alternatively, the motion types may be provided at each of a plurality of consecutive points of time in the time interval, preferably with regular intervals between the consecutive points of time. In this alternative embodiment, the degree of occurrence in the time interval of a particular motion type can be simply the number of points of time in the time interval at which said particular motion type is provided. The motion type having the highest degree of occurrence in the time interval can be determined by counting, for each motion type, the number of points of time in the time interval at which the respective motion type is provided, and by determining which motion type has the highest counted number of points of time in the time interval.

The process can be repeated for the next time interval, or the feedback can be determined continuously for a sliding time window/interval.

Figure 5:
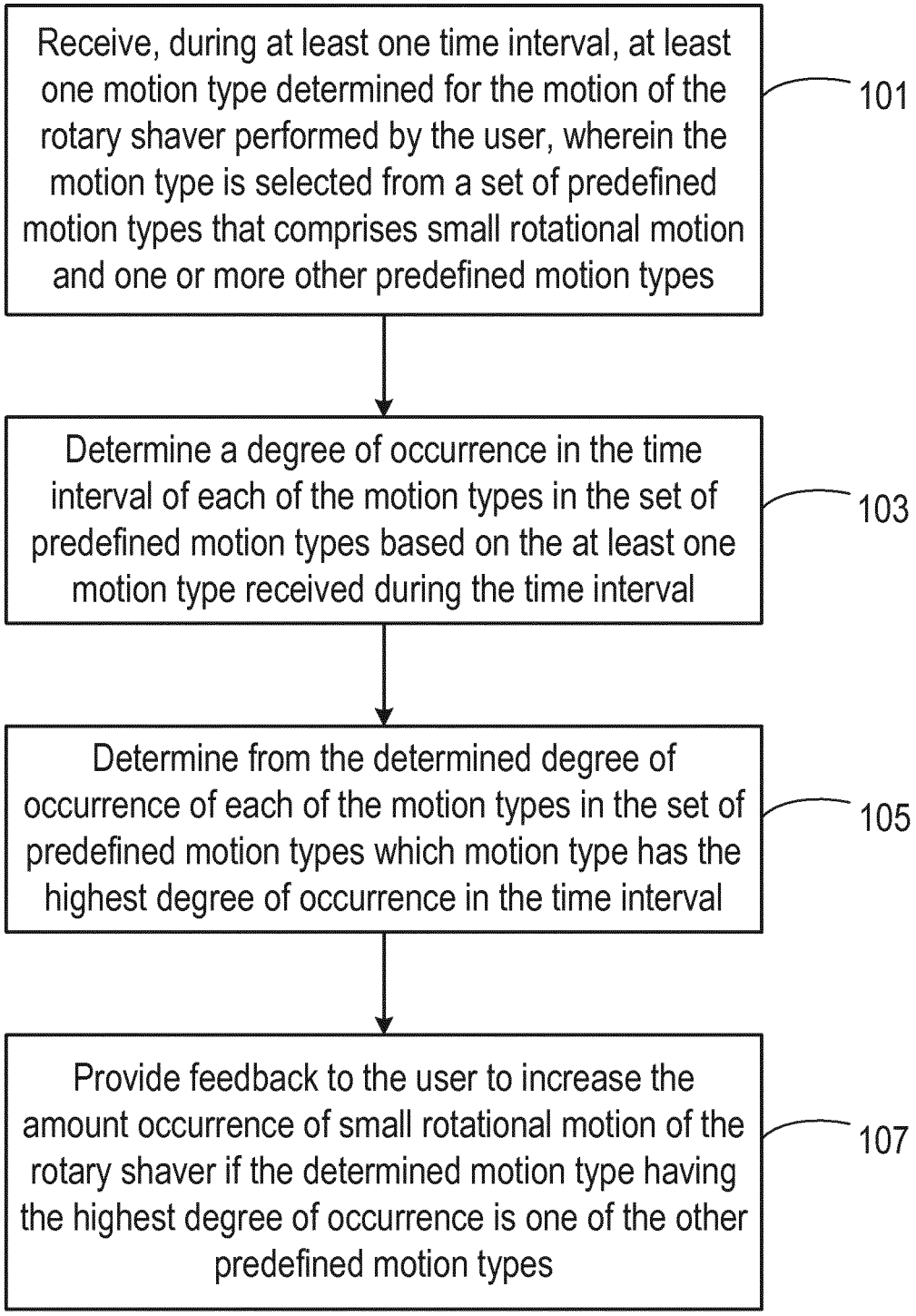
FIG. 5 is a flow chart illustrating a method of providing feedback regarding motion of a rotary shaver performed by a user according to the invention.

FIG. 5 illustrates a method of providing feedback regarding motion of the rotary shaver 8 performed by the user according to an aspect of the invention. This method can be performed by the processing unit 4 and feedback unit 6.

In a first step, step 101, which occurs during at least one time interval, at least one motion type determined for the motion of the rotary shaver 8 performed by the user is received. That is, an indication of at least one motion type performed by the user is received. The motion type is selected from a set of predefined motion types. The set of predefined motion types comprises at least small rotational motion (e.g. motion where the shaver 8 follows a generally circular or elliptical path on the body of the user) and one or more other predefined motion types. As set out above, the small rotational motion generally corresponds to rotational motion about a central region such that each point on the user's skin located in said central region of the rotational motion is covered by the shaving unit 200, i.e. in contact with the shaving unit 200, for at least part of the rotational motion. In some embodiments, the at least one other predefined motion type comprises any non-small rotational motion, i.e. any motion that is not small rotational motion. In other embodiments, the at least one other predefined motion type comprises one or more of large rotational motion, stroke (e.g. a motion in which the shaver 8 follows a straight path), large stroke and small stroke. In some embodiments, the at least one other predefined motion type can also include "no motion", where the shaver 8 is not being moved by the user (or the speed or magnitude of movement of the rotary shaver 8 is low, i.e. below a threshold). Preferably, a determined motion type is received for each part or time period in the time interval or at each of a plurality of points of time in the time interval. That is, the received motion type(s) cover the whole time interval.

In some embodiments, step 101 comprises the processing unit 4 receiving the at least one motion type from the shaver 8 (for example via the transceiver/transmitter unit 16 and transceiver/receiver unit 10). That is, the at least one motion type can be determined by the shaver processing unit 14 based on the measurements of the movement sensor 12 and communicated to the feedback device 2. The shaver 8 may communicate each determined motion type to the feedback device 2 once it has been determined, i.e. the shaver 8 may perform a separate communication operation for each time period or at each of the plurality of points of time in the time interval to communicate a determined motion type to the feedback device 2. In other embodiments, prior to step 101, the processing unit 4 can receive measurements of the motion of the rotary shaver 8 from the rotary shaver 8 and determine the at least one motion type from those measurements. In these embodiments, the processing unit 4 may receive the measurements of the motion from the rotary shaver 8 continuously, or periodically, for example a set of motion measurements can be communicated for each time period.

Those skilled in the art will be aware of various techniques that can be used to determine a motion type performed by a user from measurements by the movement sensor 12 of the motion of the rotary shaver 8, and detailed explanations of suitable techniques are not provided herein. However, a brief outline of a technique that can be used by either the shaver processing unit 14 or the processing unit 4 in the feedback device 2 is provided below.

Next, in step 103, a degree of occurrence in the time interval of each of the motion types in the set of predefined motion types is determined based on the at least one motion type received during the time interval. That is, a degree of occurrence is determined for each of the possible motion types in the set based on the received motion types.

In some embodiments, the degree of occurrence is the frequency (i.e. the number of times) with which each of the motion types occurs within the time interval. This embodiment is most appropriate wherein each of the time periods (to which each received motion type applies) has the same length. In alternative embodiments, the degree of occurrence can be the duration of each motion type in the time interval. The duration of each motion type can be the sum of the durations or lengths of the time periods in which that motion type has occurred. This embodiment is appropriate where the time periods for which each motion type is received have (or can have) different durations or lengths (e.g. some time periods can be shorter or longer than others). In embodiments wherein the determined motion types are received at each of a plurality of points of time in the time interval, the degree of occurrence of a particular motion type may be the counted number of points of time in the time interval at which said particular motion type is received.

Thus, step 103 determines the degree of occurrence in the time interval of the small rotational motion motion type, and the degree of occurrence in the time interval of each of the at least one non-small rotational motion motion types.

In step 105, it is determined from the determined degree of occurrence of each of the motion types in the set of predefined motion types which motion type has the highest degree of occurrence in the time interval. Thus, in some embodiments step 105 comprises determining which of the motion types has the highest frequency (i.e. which motion type has occurred the most), and in other embodiments step 105 comprises determining which of the motion types has the highest duration in the time interval. In further embodiments step 105 may comprise determining which of the motion types has the highest counted number of points of time at which the motion type was received.

Figure 6A:
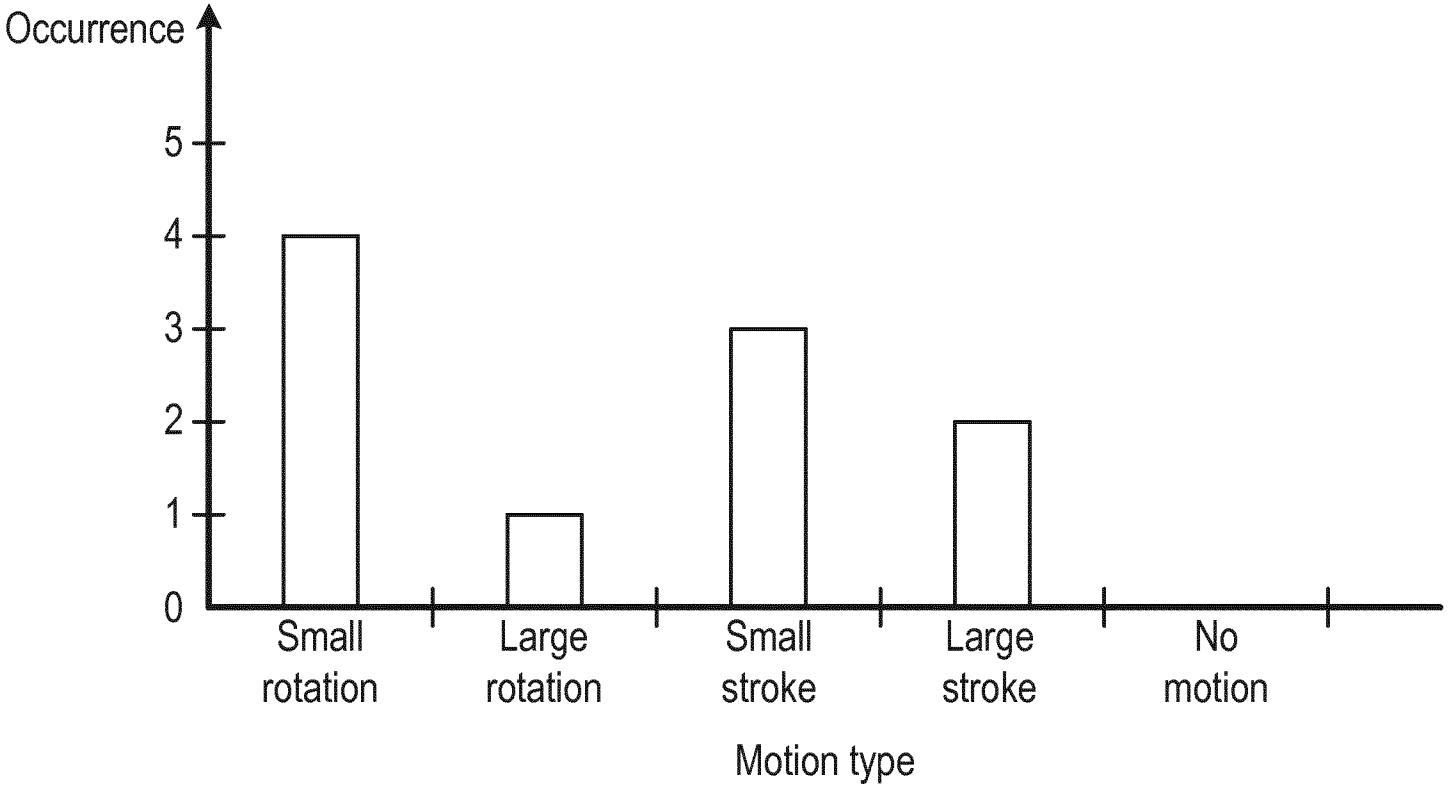
FIGS. 6(*a*) and 6(*b*) shows two exemplary histograms that can be formed from the received motion types in a method according to the invention.
Figure 6B:
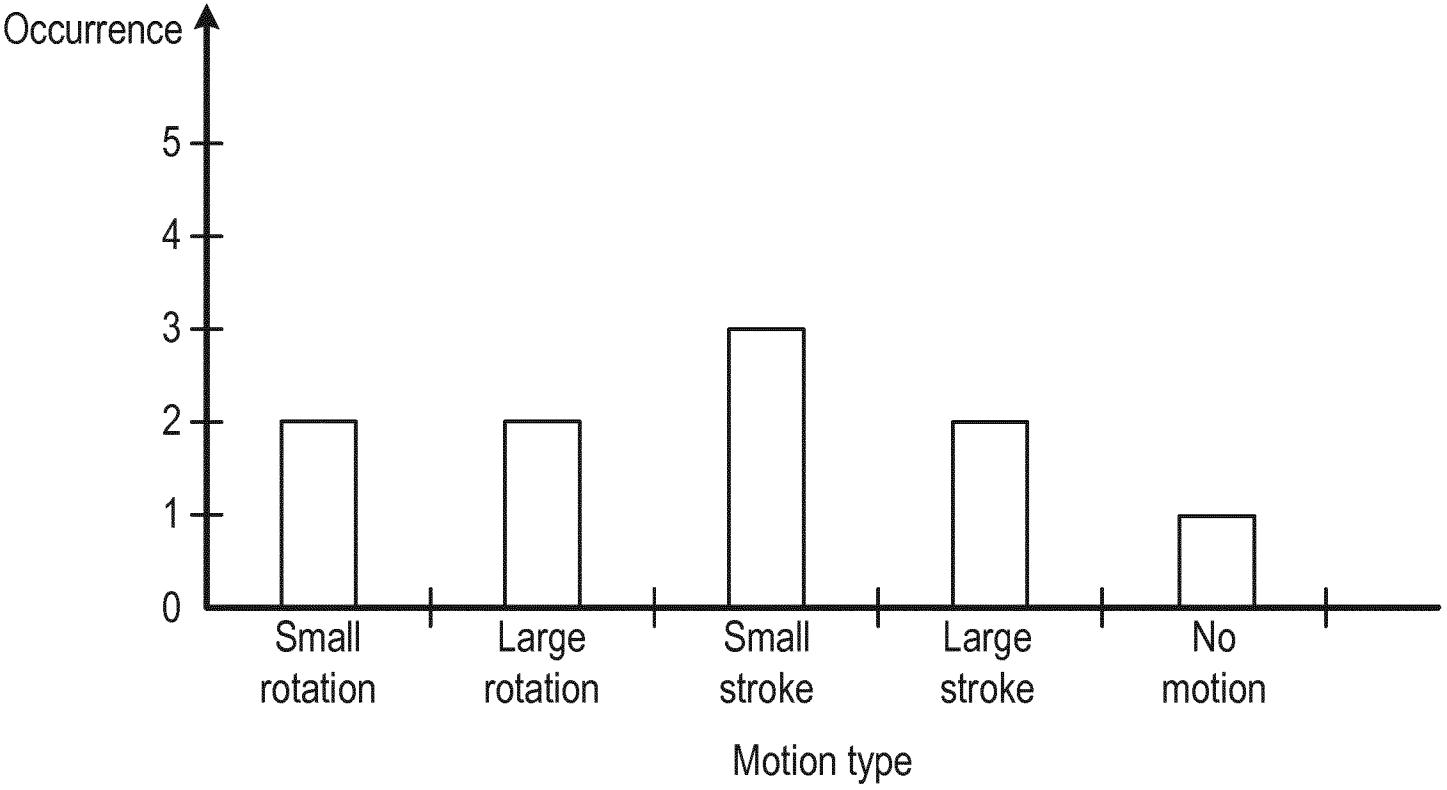

The processing in steps 103 and 105 can be considered as forming a histogram from the received motion types. Two exemplary histograms are illustrated in FIGS. 6(*a*) and 6(*b*) for two exemplary sets of motion types received during a time interval. In FIGS. 6(*a*) and 6(*b*), a motion type is received for each time period of duration of 1 second, and the time interval has a length of 10 seconds. Thus 10 motion types are received during the time interval. The histogram has a 'bin' for each of the motion types in the set, namely small rotational motion, large rotational motion, small stroke, large stroke and no motion.

In FIG. 6(*a*), it can be seen that the received motion types comprised four occurrences of small rotational motion, one occurrence of large rotational motion, three occurrences of small stroke, two occurrences of large stroke and no occurrences of no motion. It will be appreciated that the histogram simply represents the number of occurrences of each motion type and does not represent the order in which the motion types were received. Thus, step 103 can comprise forming the histogram shown in FIG. 6(*a*), and step 105 can comprise identifying the bin in the histogram having the highest occurrence, in this case the small rotational motion bin. In some embodiments, step 105 can comprise ordering the bins according to the occurrence.

In FIG. 6(*b*) it can be seen that the received motion types comprised two occurrences of small rotational motion, two occurrences of large rotational motion, three occurrences of small stroke, two occurrences of large stroke and one occurrence of no motion. As with FIG. 6(*a*) it will be appreciated that the histogram simply represents the number of occurrences of each motion type and does not represent the order in which the motion types were received. Thus, step 103 can comprise forming the histogram shown in FIG. 6(*b*), and step 105 can comprise identifying the bin in the histogram having the highest occurrence, in this case the small stroke bin.

In embodiments where the duration of each time period may be different, for example where the duration of the time period is determined by the length of time that a particular motion type occurred (e.g. if the user performs a large rotational motion for 4.3 seconds, the duration of the time period associated with that motion type would be 4.3 seconds), then the histogram in step 103 can be formed with the Occurrence axis representing the total duration of each motion type. Thus, a 4.3-second long period of large rotational motion will result in a 4.3-second high entry in the large rotational motion bin of the histogram. Subsequent time periods of large rotational motion will further increase the size of the entry in the large rotational motion bin.

Once the motion type having the highest degree of occurrence in the time interval has been determined in step 105, feedback may be provided to the user in step 107. In particular, if the determined motion type having the highest degree of occurrence is one of the other predefined motion types and is not a no motion motion type (i.e. any non-small rotational motion motion type or a specific non-rotational motion motion type such as large stroke, small stroke, etc.), then feedback is provided that indicates to the user that he should increase the occurrence of small rotational motion of the rotary shaver 8. The feedback can be provided in any suitable form, as outlined above, for example as a written message, an audible message or tone and/or in a tactile/haptic format.

In some embodiments, if the determined motion type having the highest degree of occurrence is small rotational motion, then the method can further comprise providing feedback to the user indicating that the occurrence of small rotational motion is correct or acceptable, or that the user should continue moving the shaver as he is moving the shaver.

In some embodiments, if the determined motion type having the highest degree of occurrence is no motion, then the method can further comprise providing feedback to the user indicating that he should start moving the rotary shaver 8. In some embodiments, this feedback can indicate to the user that he should move the shaver 8 using a small rotational motion.

Figure 7:
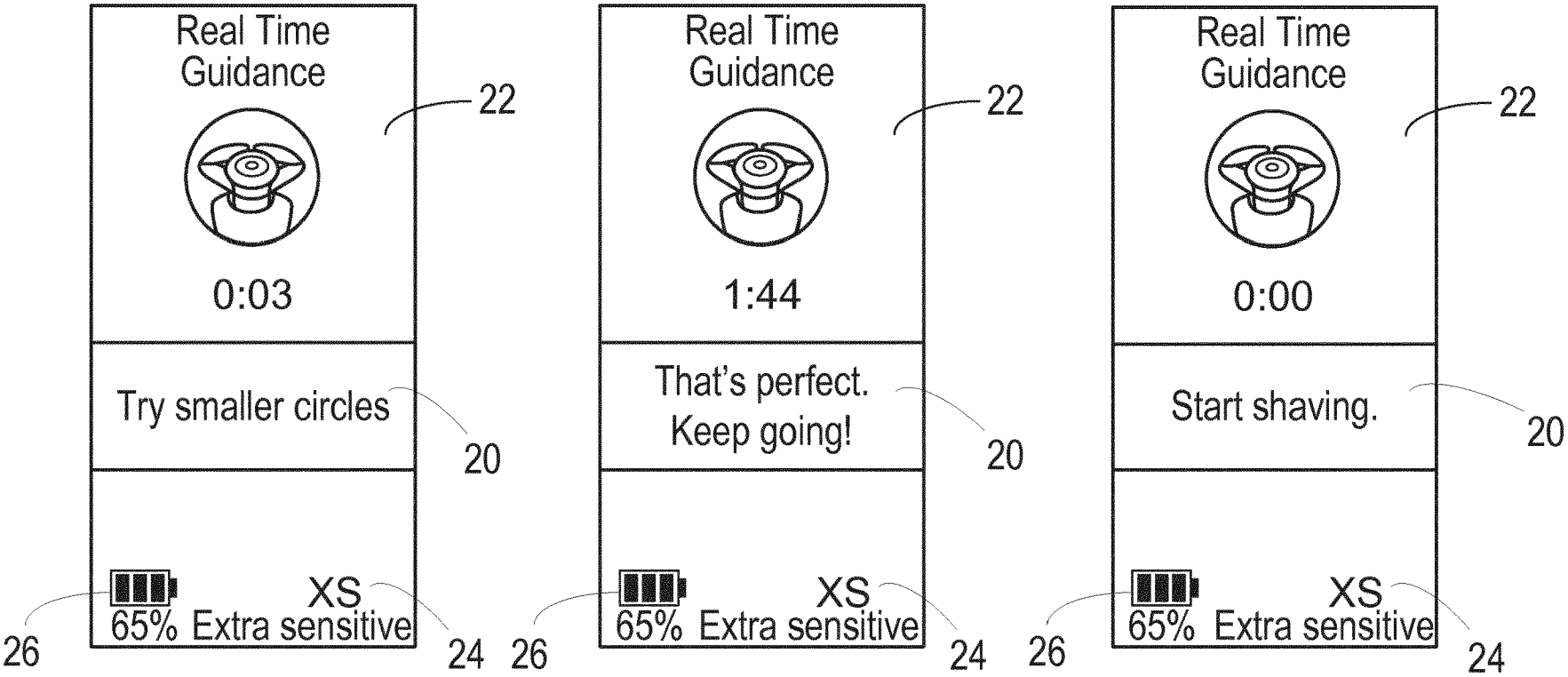
FIGS. 7(*a*), 7(*b*) and 7(*c*) show three screen shots with feedback that can be provided by an application on a personal electronic device.

The images in FIG. 7 illustrate three examples of feedback that can be provided according to the invention. In particular the three examples are screen shots of an application running on a smart device, such as a smart phone or tablet. Each screen shot shows a feedback message 20 along with various other optional information. The screen shot in FIG. 7(*a*) shows the feedback provided when the determined motion type having the highest degree of occurrence is not small rotational motion and is not no motion, and the feedback message 20 states that the user should "Try smaller circles". The screen shot in FIG. 7(*b*) shows the feedback provided when the determined motion type having the highest degree of occurrence is small rotational motion, and the feedback message 20 is positive, stating "That's perfect. Keep going!". The screen shot in FIG. 7(*c*) shows the feedback provided where the determined motion type having the highest degree of occurrence is no motion, and the feedback message 20 states that the user should "Start shaving". Optionally in the latter example the feedback message 20 could alternatively or additionally advise the user to use a small circular or small rotational motion. It will be appreciated that the particular wording shown in the examples of FIG. 7 can be varied in a number of ways while still providing an indication that the occurrence of small rotational motion should be increased, the current motion is acceptable or correct, or the user should start shaving, respectively.

In addition or as an alternative to the feedback message 20, feedback can be conveyed to the user via one or more other indications, such as the colour of the display and/or the presence of an icon or symbol (e.g. a check mark or a cross). For example the colour of the screen or part of the screen could be green for providing positive feedback to the user that the motion is correct and red for providing feedback to increase the occurrence of small circular motion.

The other optional information shown in the screen shots of FIG. 7 includes an elapsed shaving time 22, a shaving sensitivity setting 24 for the shaver 8 and a remaining battery level 26 of the shaver 8. As noted above, the feedback is determined for the time interval for which the at least one motion type has been received, and thus the time interval can have any desired length. However, it is preferable for the time interval to have a length that is appropriate for a typical shaving event, so as to provide useful feedback to the user to improve the current shaving event, while avoiding the method resulting in the feedback to the user changing too frequently (for example every second or few seconds). Thus, the time interval can have a length in the region of 6 seconds, although shorter and longer lengths are possible, such as 3 seconds, 10 seconds, 20 seconds, etc. Each received motion type refers to the motion within a time period, and the length of the time period is equal to or less than the length of the time interval. Clearly the length of the time period determines how many motion types are received for each time interval. In some embodiments, a motion type is received for each 1-second time period, although time periods of longer and shorter lengths are possible (e.g. 0.5 seconds, 1.5 seconds, etc.).

As noted above, those skilled in the art will be aware of various techniques that can be used to determine a motion type performed by a user from measurements of the motion of the rotary shaver 8 by the movement sensor 12. As also noted above, the processing of the measurements (e.g. acceleration measurements) can be performed by the shaver processing unit 14 or the processing unit 4 in the feedback device 2 depending on the specific implementation.

In one exemplary technique, a shaving motion type detection or classification algorithm can be determined based on the analysis of several shaving 'test' sessions by one or more different users. In particular one or more users can perform a shaving routine using a rotary shaver that comprises a movement sensor 12, while the user and shaver is observed, either by a camera or another person, so that the motion type can be visually classified into the different motion types in the set of predefined motion types. Subsequently, the movement sensor measurements are analysed to identify respective characteristic features in the measurements which have a good correlation with the different motion types. Those skilled in the art will be aware of various techniques that can be used for this feature analysis. For example a neural network can be used that has been trained using a sample set of measurements that has been manually tagged with a motion type by an operator or observer. The neural network is a classifier/optimisation function that tries to match the tagged sample data set as close as possible. Once these characteristic features have been identified, a transfer function can be established that describes a relationship between a detected set of measurement features and the classified motion types. During use of the rotary shaver 8, the shaver processing unit 14 or the processing unit 4 in the feedback device 2 (as appropriate) can compare new measurements of the motion of the shaver 8 to the sets of characteristic data features and the transfer function and determine the current motion type.

There is therefore provided a method and apparatus that provides improvements in the feedback provided regarding the motion of a rotary shaver performed by a user to improve the shaving performance.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A method of providing feedback regarding motion of a rotary shaver performed by a user, the method comprising the steps of:

receiving, during at least one time interval, at least one motion type determined for the motion of the rotary shaver performed by the user, wherein the at least one motion type is selected from a set of predefined motion types that comprises a small rotational motion and one or more other predefined motion types, wherein the one or more other predefined motion types includes a no motion motion type;

determining a degree of occurrence in the time interval of each of the motion types in the set of predefined motion types based on the at least one motion type received during the time interval;

determining from the determined degree of occurrence of each of the motion types in the set of predefined motion types which motion type has a highest degree of occurrence in the time interval; and providing feedback to the user to increase a degree of occurrence of the small rotational motion of the rotary shaver if the determined motion type having the highest degree of occurrence is one of the one or more other predefined motion types other than the no motion motion type.

2. The method as claimed in claim 1, wherein the method further comprises the step of:

providing feedback to the user indicating that the degree of occurrence of the small rotational motion of the rotary shaver is acceptable if the determined motion type having the highest degree of occurrence is the small rotational motion.

3. The method as claimed in claim 1, wherein the one or more other predefined motion types comprises one or more of a large rotational motion, a stroke, a large stroke, and a small stroke.

4. The method as claimed in claim 1, wherein the set of predefined motion types comprises the no motion motion type, and the method further comprises the step of:

providing feedback to the user to start moving the rotary shaver if the determined motion type having the highest degree of occurrence is the no motion motion type.

5. The method as claimed in claim 1, wherein the step of receiving at least one motion type comprises receiving a respective motion type at each of a plurality of points of time in the time interval.

6. The method as claimed in claim 5, wherein the degree of occurrence in the time interval of a particular motion type in the set of predefined motion types is a number of points of time of said plurality of points of time at which said particular motion type is received.

7. The method as claimed in claim 1, wherein the degree of occurrence in the time interval of a particular motion type in the set of predefined motion types is a frequency with which said particular motion type occurs within the time interval.

8. The method as claimed in claim 1, wherein the degree of occurrence in the time interval of a particular motion type in the set of predefined motion types is a duration of said particular motion type within the time interval.

9. The method as claimed in claim 1, wherein the step of receiving at least one motion type comprises receiving from the rotary shaver the at least one motion type determined for the motion of the rotary shaver performed by the user.

10. The method as claimed in claim 1, wherein the small rotational motion corresponds to a rotational motion about a central region such that each point on skin of the user in said central region is in contact with the rotary shaver for at least part of the rotational motion.

11. A computer program product comprising a computer readable medium having computer readable code embodied therein, the computer readable code being configured such that, on execution by a suitable computer or processor, the computer or processor is caused to perform the method of claim 1.

12. An apparatus for providing feedback regarding motion of a rotary shaver performed by a user, the apparatus comprising:

a feedback unit for providing feedback to the user; and a processing unit configured to:

receive, during at least one time interval, at least one motion type determined for the motion of the rotary shaver performed by the user, wherein the motion type is selected from a set of predefined motion types that comprises a small rotational motion and one or more other predefined motion types, wherein the one or more other predefined motion types includes a no motion motion type;

determine a degree of occurrence in the time interval of each of the motion types in the set of predefined motion types based on the at least one motion type received during the time interval;

determine from the determined degree of occurrence of each of the motion types in the set of predefined motion types which motion type has a highest degree of occurrence in the time interval; and cause the feedback unit to provide feedback to the user to increase a degree of occurrence of the small rotational motion of the rotary shaver if the determined motion type having the highest degree of occurrence is one of the one or more other predefined motion types other than the no motion motion type.

13. A system comprising:

the apparatus as claimed in claim 12;

a rotary shaver; and a movement sensor for measuring movement of the rotary shaver over time.

14. The system as claimed in claim 13, wherein the rotary shaver further comprises a shaver processing unit that is configured to:

receive measurements of the movement of the rotary shaver over time from the movement sensor;

process the received measurements to determine, during the at least one time interval, the at least one motion type for the motion of the rotary shaver performed by the user; and provide the determined at least one motion type to the processing unit of the apparatus.

15. The system as claimed in claim 13, wherein the processing unit is further configured to:

receive measurements of the movement of the rotary shaver over time from the movement sensor; and process the received measurements to determine, during the at least one time interval, the at least one motion type for the motion of the rotary shaver performed by the user.

* * * * *